United States Patent [19]

Kamioka

[11] 4,350,530

[45] Sep. 21, 1982

[54] SINTERED ALLOY FOR FRICTION MATERIALS

[75] Inventor: Nobuo Kamioka, Kasukabe, Japan

[73] Assignee: Akebono Brake Industry Co., Ltd., Tokyo, Japan

[21] Appl. No.: 136,301

[22] Filed: Apr. 1, 1980

[51] Int. Cl.[3] ..... B22F 5/00

[52] U.S. Cl. ..... 75/231; 75/228; 106/36; 188/251 A; 188/251 M; 192/107 M

[58] Field of Search ..... 75/231, 228; 106/36; 188/251 A, 251 M; 192/10.7 M

[56] References Cited

U.S. PATENT DOCUMENTS

| | | | |
|---|---|---|---|
| 2,945,292 | 7/1960 | Luther Jr. et al. | 106/36 |
| 3,019,514 | 2/1962 | Bickelhaupt et al. | 106/36 |
| 3,067,493 | 12/1962 | Sampson | 75/231 |
| 3,437,458 | 4/1969 | Völker et al. | 75/243 |

FOREIGN PATENT DOCUMENTS 54-43808 1/1975 Japan .

*Primary Examiner*—Brooks H. Hunt

*Attorney, Agent, or Firm*—Toren, McGeady and Stanger

[57] ABSTRACT

Fe-base sintered alloy friction materials containing 3 to 15% of bismuth of Bi-Pb alloy containing 5 to 100% bismuth, which provide very stable friction coefficient over a wide range from low temperature zones to high temperature zones, and very excellent wear resistance.

1 Claim, 4 Drawing Figures

SINTERED ALLOY FOR FRICTION MATERIALS

BACKGROUND OF THE INVENTION

1. Field of the Invention

The present invention relates to iron-base sintered alloy for friction materials, useful as brakes for vehicles.

2. Description of Prior Art

Conventional sintered alloy friction materials used in brakes for rolling stock have better wear resistance than conventional cast iron brake blocks, but on the other hand, have a disadvantage that their friction coefficient is considered to be relatively high because of difficulties in incorporating lubricants functioning as free carbon in the cast iron brake blocks.

For the purpose of lowering the friction coefficient a lubricant is incorporated into the friction materials, and graphite or $MoS_2$ is usually added to the sintered alloys for the purpose of improving the friction coefficient in a low-speed zone (low temperature zone) to which the brake material is subjected, but these lubricants produce only low lubricity at high temperatures, and in the worst case, not only the friction materials are burnt to the mating materials, thus unstabilizing the friction coefficient, but also the lubricants, when added excessive amounts, adhere to the tread surface of the wheels, thus causing the wheel slip.

In order to improve the friction coefficient at high temperatures, it has been tried to admix high-temperature lubricants for the high-speed zone, but these high-temperature lubricants, due to their high melting points, fail to exert satisfactory lubricating effect in the most frequently used intermediate zone between the low-speed zone and the high-speed zone.

SUMMARY OF THE INVENTION

Therefore, one of the objects of the present invention is to provide sintered alloy friction materials which show a stable friction coefficient and satisfactory lubricity over a wide range covering from the low-speed zone to the high-speed zone.

The present inventors have conducted various extensive studies using low-melting point lubricants for developing sintered Fe-base alloys which show a satisfactory lubricity under relatively low temperature conditions as well as under relatively high temperature conditions.

It has been found by the present inventors that most of the lubricants which have been regarded as low-melting point lubricants diffuse into the base metal during the sintering process, thus failing to function as so-called "solid laminar lubricants", and that bismuth (Bi) or bismuth-lead (Bi-Pb) alloy when added to the sintered iron-base alloys in specific amounts can produce the desired properties.

Bi or Bi-Pb alloy can produce desired lubricity for various service temperature zones. For example, Bi-Pb alloy containing 20 to 70% Bi has a melting point between about 125 and about 200° C. The melting point of Bi-Pb alloy can be controlled by changing the proportions of Bi and Pb so as to assure a satisfactory lubricity for a given service temperature zone.

Bi or Bi-Pb alloy forms a liquid lubricating film which gives a satisfactory lubricity.

If the addition of Bi or Bi-Pb alloy is too small, the resultant liquid lubricating film is too thin to give a satisfactory lubricity, but on the other hand, if the addition is excessive, they flow out during the sintering and lower the strength of the resultant sintered products. Therefore, it is desirable that Bi or Bi-Pb alloy (Bi: 5–100%) is added in an amount ranging from 3 to 15% by weight in the sinter composition.

Bi and Pb may be added separately instead of Bi-Pb alloy, because they are alloyed together during the sintering to give a satisfactory lubricity.

The basic composition of the Fe-base sintered alloy according to the present invention comprises:

| | by weight % |
|---|---|
| Fe | 50–90 |
| Bi or Bi—Pb (Bi: 5–100%) | 3–15 |
| Graphite | 1.0–10 |
| $MoS_2$ | 2.0–6.0 |
| Grinding additive | 3–15 |

A modified composition may contain copper in an amount ranging from 10 to 50% based on the iron content, and further contain Sn in an amount ranging from 1/7 to 1/20 of the copper content. Copper is effective to lower the sintering temperature.

The present invention will be better understood by the following embodiments:

EXAMPLES

The sinter materials were mixed, formed under a pressure between 3.5 and 4.5 ton/cm$^2$, subjected to primary sintering at a temperature between 900° and 1000° C. for a period of time between 0.5 and 2 hours, further subjected to a secondary sintering at a temperature between 800° and 900° C. for a period of time between 0.5 and one hour to bond with a reinforced plate made of steel, and strain-relieved under a pressure between 400 and 500 kg/cm$^2$ so as to obtain final shapes. The resultant sintered alloy compositions are shown in Table 1.

Figure 1A:
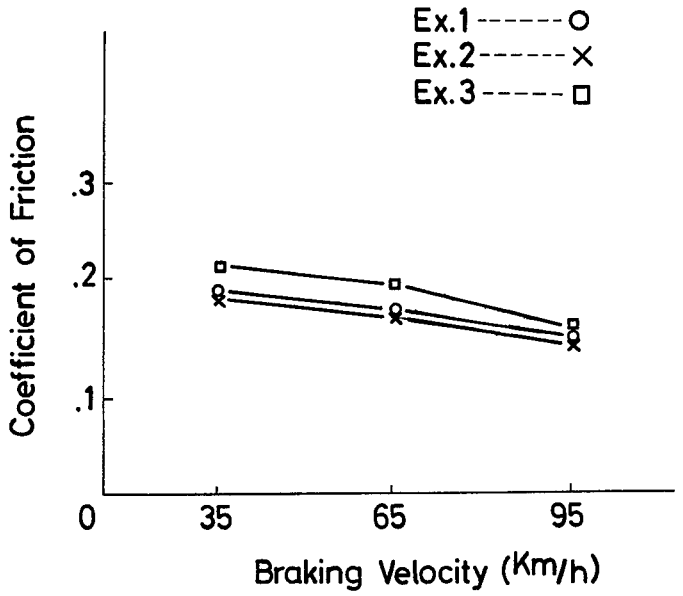
FIG. 1(*a*) to FIG. 1(*d*) respectively show the coefficients of friction of the examples of the present sintered alloy at various braking velocities in comparison with the conventional cast iron brake block.
Figure 1B:
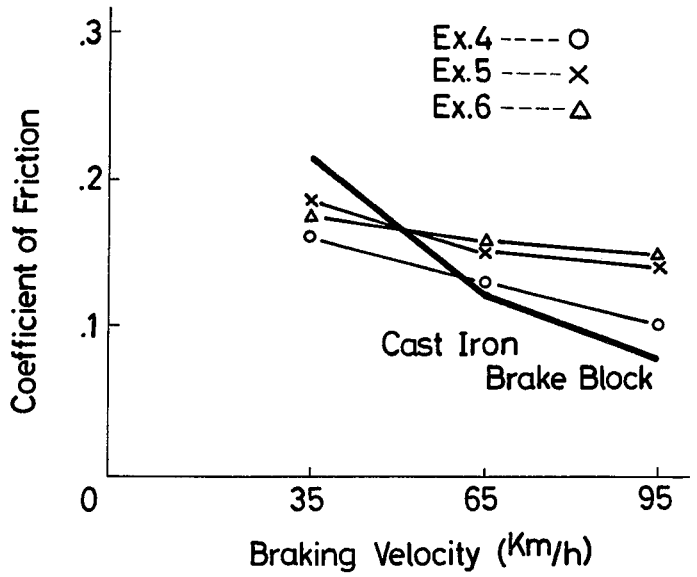
Figure 1C:
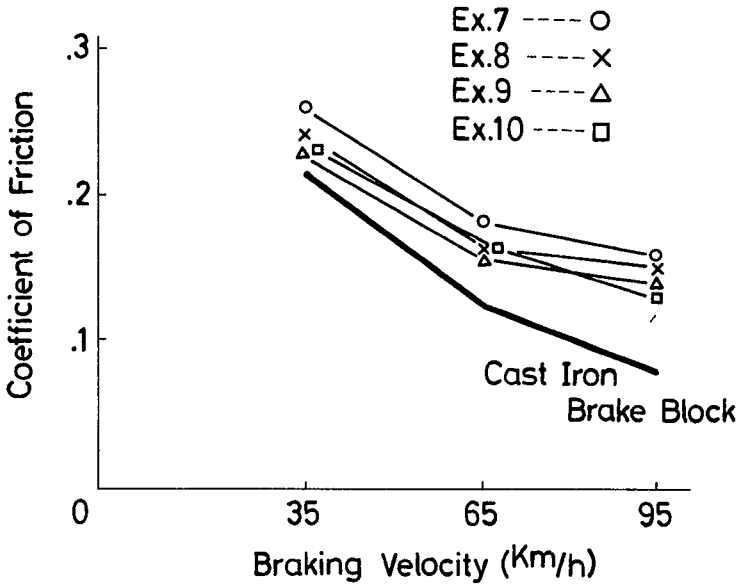
Figure 1D:
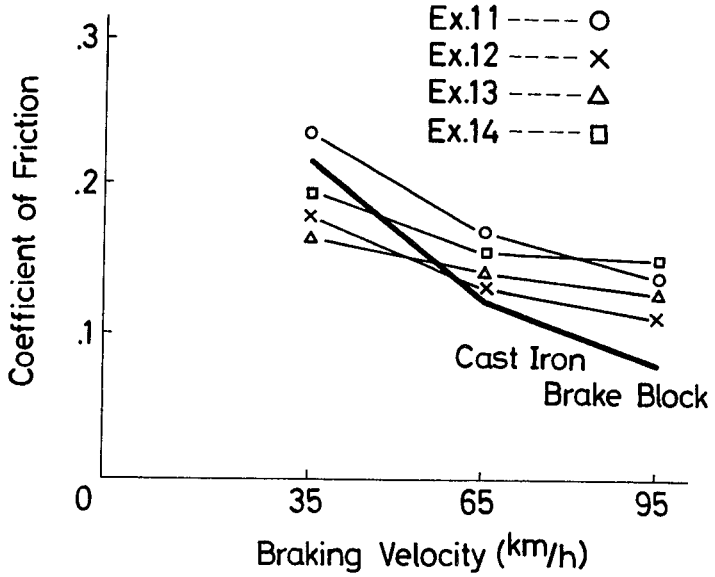

The friction coefficients at the initial speeds of braking (35, 65 and 95 km/h) of the sintered alloys (Examples 1–14) (tread-brake) according to the present invention are shown in FIGS. 1(*a*) to (*d*) in comparison with the conventional cast iron brake block, and the wear rates at the initial speeds of braking of the sintered alloys according to the present invention are shown in Table 2 in comparison with the conventional cast iron brake block.

As understood from FIGS. 1(*a*) to (*d*), the friction materials according to the present invention show quite a low friction coefficient, particularly at low initial speeds of braking as compared with the conventional cast iron brake block, and show less scatter in the friction coefficient against the changes in the initial speed of braking while the conventional friction material shows a considerably large scatter in the friction coefficient.

The results shown in FIG. 1(*a*) to FIG. 1(*d*) were obtained by the friction test under the following conditions:

Testing Conditions

Testing conditions are based on the specification by J.N.R. (the Japanese National Railways). Testing conditions are as follows (called Random Brake Test):

| | |
|---|---|
| Braking Velocity | 35, 65, 95 km/h |
| Pressure applied to Brake Block | In normal brake 2.0 ton × 2 |
| | In an emergency |
| | brake (crasp type) 3.0 ton × 2 |
| Moment of Inertia | 126 kg.m.s$^2$ |
| Area of Brake Block | 164 cm$^2$ × 2 |
| Numbers of Brake are as follows | |

| Braking Velocity | Item: Normal Brake | Item: Emergency Brake |
|---|---|---|
| 35 (km/h) | 4 (times) | 1 |
| 65 (km/h) | 4 | 1 |
| 95 (km/h) | 5 | 4 |

Also as understood from Table 2, the friction materials according to the present invention show excellent wear resistance as compared with the conventional friction material.

Further, it has been revealed that the friction materials according to the present invention can provide a satisfactory adhesion. In Examples 4–13, $ZrSiO_4$ was used instead of $Al_2O_3$ because $ZrSiO_4$ show less attack on the mating materials of the brake.

The Fe-base sintered alloy friction materials according to the present invention can not only provide a stable lubricity over a wide range from a low temperature zone to a high temperature zone but also very excellent wear resistance.

TABLE 1

| Examples | Skeleton: Fe | Skeleton: Cu | Skeleton: Sn | Solid lubricants: Graphite | Solid lubricants: $MoS_2$ | Metallic lubricants: Bi | Metallic lubricants: Pb | Grinding material: $Al_2O_3$ | Grinding material: $ZrSiO_4$ |
|---|---|---|---|---|---|---|---|---|---|
| 1 | 73 | 0 | 0 | 4.0 | 5.0 | 7.5 | 6.5 | 4.0 | 0 |
| 2 | 73 | 8.3 | 1.0 | 3.5 | 4.5 | 3.6 | 3.1 | 3.0 | 0 |
| 3 | 74.2 | 8.2 | 1.0 | 3.0 | 4.0 | 2.7 | 2.4 | 4.5 | 0 |
| 4 | 79 | 0 | 0 | 1.0 | 2.0 | 7.5 | 6.5 | 0 | 4.0 |
| 5 | 77 | 8.3 | 1.0 | 1.0 | 3.0 | 3.6 | 3.1 | 0 | 3.0 |
| 6 | 74.2 | 8.2 | 1.0 | 3.0 | 4.0 | 2.7 | 2.4 | 0 | 4.5 |
| 7 | 45 | 23 | 4.0 | 5.0 | 5.0 | 8.0 | 0 | 0 | 10.0 |
| 8 | 50 | 20 | 3.0 | 3.0 | 4.0 | 2.0 | 4.0 | 0 | 14.0 |
| 9 | 60 | 15 | 2.0 | 2.0 | 5.0 | 2.0 | 9.0 | 0 | 5.0 |
| 10 | 70 | 10 | 1.0 | 1.0 | 5.0 | 2.0 | 7.0 | 0 | 4.0 |
| 11 | 60 | 15 | 1.0 | 1.0 | 5.0 | 1.0 | 9.0 | 0 | 8.0 |
| 12 | 55 | 15 | 2.0 | 5.0 | 4.0 | 6.0 | 5.0 | 0 | 8.0 |
| 13 | 55 | 15 | 2.0 | 4.0 | 3.0 | 7.0 | 6.0 | 0 | 8.0 |
| 14 | 55 | 15 | 2.0 | 5.0 | 4.0 | 6.0 | 5.0 | 8.0 | 0 |

TABLE 2

| Examples | Amounts of Wear of Brake Blocks (g) | Relative Decrease in Thickness to the Thickness Decrease (100) of cast iron |
|---|---|---|
| 1 | 5.0 | 7.5 |
| 2 | 21.0 | 23 |
| 3 | 30.5 | 26 |
| 4 | 15 | 22.5 |
| 5 | 24.5 | 26.1 |
| 6 | 28.5 | 30.8 |
| 7 | 33 | 27 |
| 8 | 22.5 | 24 |
| 9 | 13 | 14 |
| 10 | 22.5 | 24 |
| 11 | 25 | 27 |
| 12 | 6 | 6.4 |
| 13 | 7 | 7.5 |
| 14 | 3.5 | 3.7 |
| Cast Iron Brake Block | 135 | 100 |

What is claimed is:

1. A Fe-base sintered alloy friction material comprising 3 to 15% by weight of bismuth, copper in an amount ranging from 10 to 50% by weight of the iron content and tin in an amount ranging from 1/7 to 1/20 by weight of the copper content.

* * * * *